US006467101B1

(12) United States Patent
Artola

(10) Patent No.: US 6,467,101 B1
(45) Date of Patent: Oct. 22, 2002

(54) TOILET FLUSHING AND CLEANING DEVICE

(76) Inventor: Jorge Artola, P.O. Box 40605, San Francisco, CA (US) 94140

( * ) Notice: Subject to any disclaimer, the term of this patent is extended or adjusted under 35 U.S.C. 154(b) by 0 days.

(21) Appl. No.: 10/004,227

(22) Filed: Oct. 31, 2001

(51) Int. Cl.[7] ..... E03D 3/10

(52) U.S. Cl. ..... 4/354; 4/213; 4/334; 4/361; 4/362; 4/366; 4/386; 4/435; 4/440; 4/441

(58) Field of Search ..... 4/334, 213, 337, 4/219, 354–359, 361, 362, 363, 366, 367, 378, 379, 386, 387, 434, 435, 438, 440, 441, 442

(56) References Cited

U.S. PATENT DOCUMENTS 3,798,681 A * 3/1974 Johansen ..... 4/440
3,813,701 A * 6/1974 Stevens ..... 4/362
4,510,629 A 4/1985 Jovy et al.
6,016,576 A 1/2000 Happe
6,070,276 A * 6/2000 Yeung ..... 4/441
6,073,275 A 6/2000 Klopocinski

* cited by examiner

*Primary Examiner*—Timothy L. Maust
*Assistant Examiner*—Tuan Nguyen
(74) *Attorney, Agent, or Firm*—Anderson & Morishita; Robert Ryan Morishita

(57) ABSTRACT

A toilet flushing and cleaning device includes a reservoir with a cylinder and a mixing tube disposed therein. The cylinder communicates with a water source. A plunger is slidably disposed in the cylinder. A plurality of spray nozzles communicate with the mixing tube. When a flush valve is opened to allow water into the cylinder, the piston is driven upwards. The increase in air pressure drives pressurized air and water into the mixing tube such that the spray nozzles clean the toilet with a burst of air-water mixture. In a further embodiment, a funnel is disposed in the toilet bowl and a bucket is suspended at the lower opening of the funnel. When the piston is driven upwards, the bucket is pivoted to release its contents. Additionally, a blower disposed between the funnel and the toilet bowl may be used to drawing air and odors from inside said funnel and directing air into said toilet bowl for release through the existing drain pipe and vent pipe.

8 Claims, 8 Drawing Sheets

TOILET FLUSHING AND CLEANING DEVICE

FIELD OF THE INVENTION

The present invention relates to a toilet flushing and cleaning device. Specifically, the present device uses high pressure water sprays and gravity instead of the siphon of conventional toilets and, in one embodiment, includes a blower for removing toilet odor through the existing drain waste vent.

BACKGROUND OF THE INVENTION

There are dozens of patents directed to reducing the amount of water for flushing and rinsing toilets and removing the noxious odors. However, a common factor to all these patents is that they use mechanisms too intricate and procedures too elaborate to accomplish their goal. Moreover, these systems do not appeal to manufacturers because they are typically not cost-effective in mass production. In short, these systems are not practical.

Consequently, the modern commode is far from efficient. Millions of gallons of fresh potable water are literally thrown out the drain as a vehicle to carry human waste. This creates not only an environmental loss of one of our most vital resources but, in addition, exacts an expensive price for the rising cost of water that escalates even more with the sewerage treatment it eventually requires.

Most modem toilets depend only on the potential energy of a volume of water for flushing and cleaning. The still water laying in the tank has been dispossessed of its complimentary energy: pressure. The potential energy of the water, by virtue of its volume and weight alone, has to be converted to a certain level of kinetic energy so the siphon will carry out the waste and clean the bowl. Some other toilets use a raised tank to increase the potential energy and maintain some of its original flush pressure for better efficiency but this increases the costs. Also, there are tankless high pressure flush systems that utilize the kinetic energy of water and even jet nozzles in conjunction with siphons which need large quantities of water to operate successfully. Consequently, these systems are often are more expensive, complicated, and noisy.

The removal of noxious odors is another challenge tackled in a similar way. However, the proposed solutions are often so impractical that manufacturers are left with no other alternative than to use the current exhaust fan system. While effective at dispersing odor throughout a bathroom, a central exhaust fan does nothing to remove the odor from a bathroom altogether.

For example, one typical solution is shown in U.S. Pat. No. 6,016,576 which removes odors from the toilet bowl using a fan but does not vent the odors from the fan housing. Similarly, U.S. Pat. No. 6,073,275 discloses a system for removing odor from the toilet bowl and delivering it to the sewage drain downstream of the toilet water trap. However, the system is very complicated and very costly.

Therefore, it can be seen that there is a need in the art for a water saving flushing system that uses the pressure of a water source to clean and flush the toilet. Additionally, there is a need in the art for a system for conducting odors from a toilet through the existing drain waste vent piping.

SUMMARY OF THE INVENTION

The present invention is a toilet flushing and cleaning device for a toilet, including a toilet bowl, connected to a water source delivering water under pressure to the toilet. In one optional embodiment, a funnel having an upper opening substantially sealed to the toilet bowl and a lower opening is disposed inside the toilet bowl. In a further embodiment, a pivotable bucket is disposed over the lower opening of the funnel. In such an embodiment, the pivotable bucket has substantially continuous walls and an opening. The optional bucket is described in further detail below.

The device includes a reservoir. The reservoir optionally includes an air inlet with a check valve that prevents air from exiting the reservoir through the air inlet when the air pressure inside the reservoir is greater than ambient and allows air to enter the reservoir through the air inlet when the air pressure inside the reservoir is less than or equal to ambient.

Disposed inside the reservoir is a cylinder having a base and a top. The cylinder includes at least one drain hole at its base and at least one discharge hole at its top. The cylinder is in fluid communication with the water source. A piston, slidable between the cylinder base and the cylinder top, is disposed in the cylinder. In an embodiment including a bucket, the piston is attached to one side of the bucket such that when the piston is at the base of the cylinder, the bucket opening is oriented vertically upward and when the piston is at the top of the cylinder, the bucket is pivoted approximately ninety degrees. A counterweight may be provided on the bucket to bias the bucket into the vertically upwards orientation.

A mixer tube is disposed inside the reservoir. The mixer tube has a lower end, with a water entrance hole, and an upper end, with an air entrance hole. The mixer tube fluidly communicates with spray nozzles. In one embodiment of the present invention, the spray nozzles are directed into the toilet bowl. In an alternate embodiment of the present invention, the spray nozzles are disposed around the upper opening of the funnel and directed into the funnel. In yet another alternate embodiment, the spray nozzles are directed into the optional funnel and at least one nozzle is directed into the optional bucket.

A flush valve is disposed between the water source and the cylinder. When the flush valve is opened, water from the water source flows into the cylinder and drives the piston from the base to the top of the cylinder. In the optional embodiment including a bucket, the motion of the piston pivots the bucket approximately ninety degrees. The piston forces water and air through the discharge hole in the cylinder to increase the air pressure inside said reservoir. Consequently, air is forced into the air entrance hole in the mixer tube. Simultaneously, a portion of the water flows out the drain hole at the base of the cylinder, an into the water entrance hole in the mixer tube. The air and water mix in the mixer tube and flow to the spray nozzles. When the flush valve is closed, the piston slides from the top of the cylinder to the base of the cylinder thereby lowering the air pressure inside the reservoir and allowing air to flow into the reservoir through the air inlet. In an optional embodiment, the piston is forced downward by the counterweight and the weight of the water inside the reservoir creates a partial vacuum to cause the check valve to open. Water remaining in the reservoir drains into the bucket for the next use.

In an embodiment including a funnel, odor may be removed from the funnel by providing a blower disposed between the funnel and the toilet bowl to draw air from inside the funnel and direct the air into the toilet bowl. This air may then flow through the drain waste vent.

It is an object of the invention to provide a water saving flushing system that uses the pressure of a water source to clean and flush the toilet. In a further optional embodiment of the present invention, another object of the invention is to provide a device for conducting odors from a toilet through the existing drain waste vent piping.

DESCRIPTION

Figure 1:
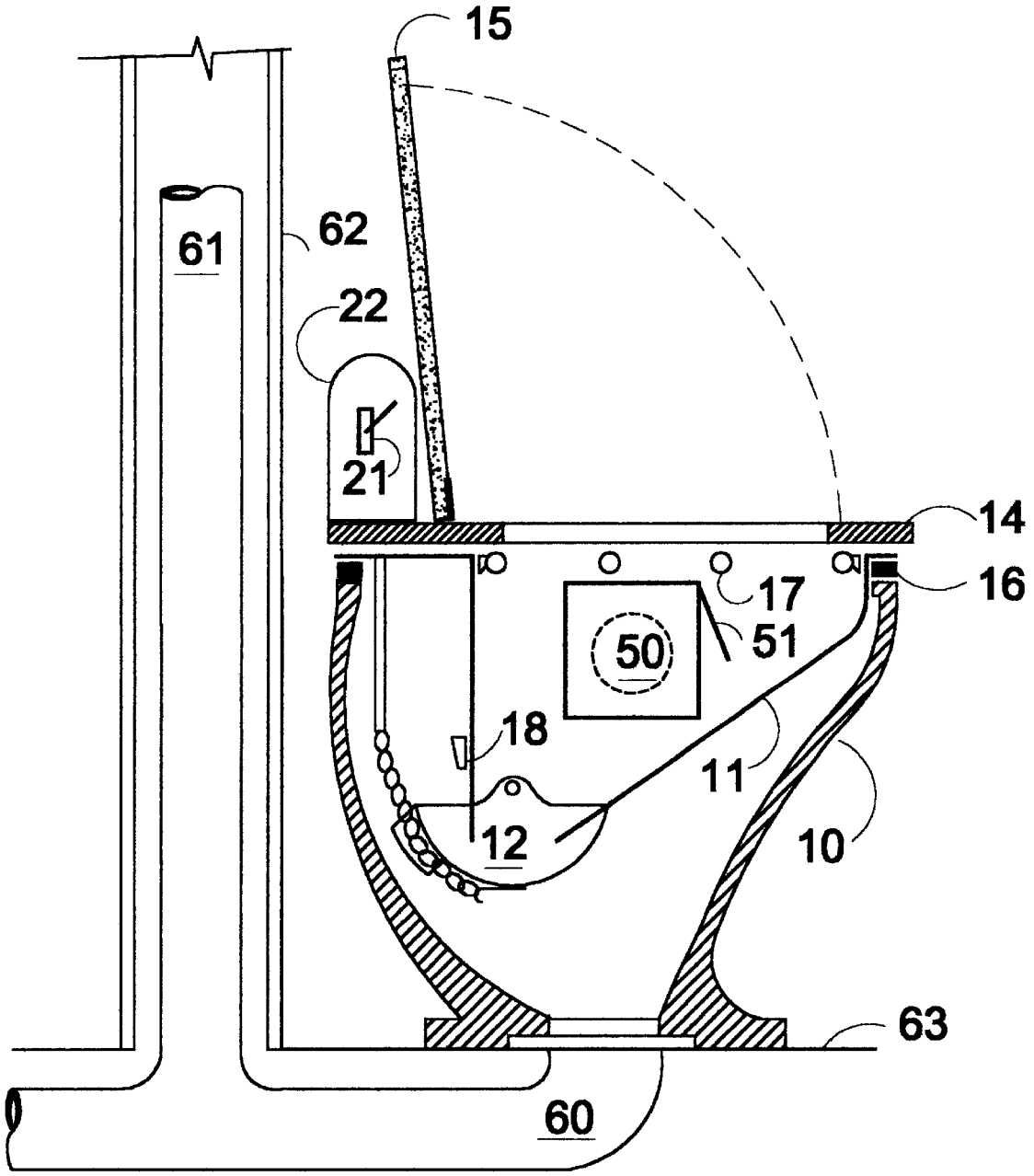
FIG. 1 is a cutaway side view of a toilet including a flushing and cleaning device according to an embodiment of the present invention.
Figure 2:
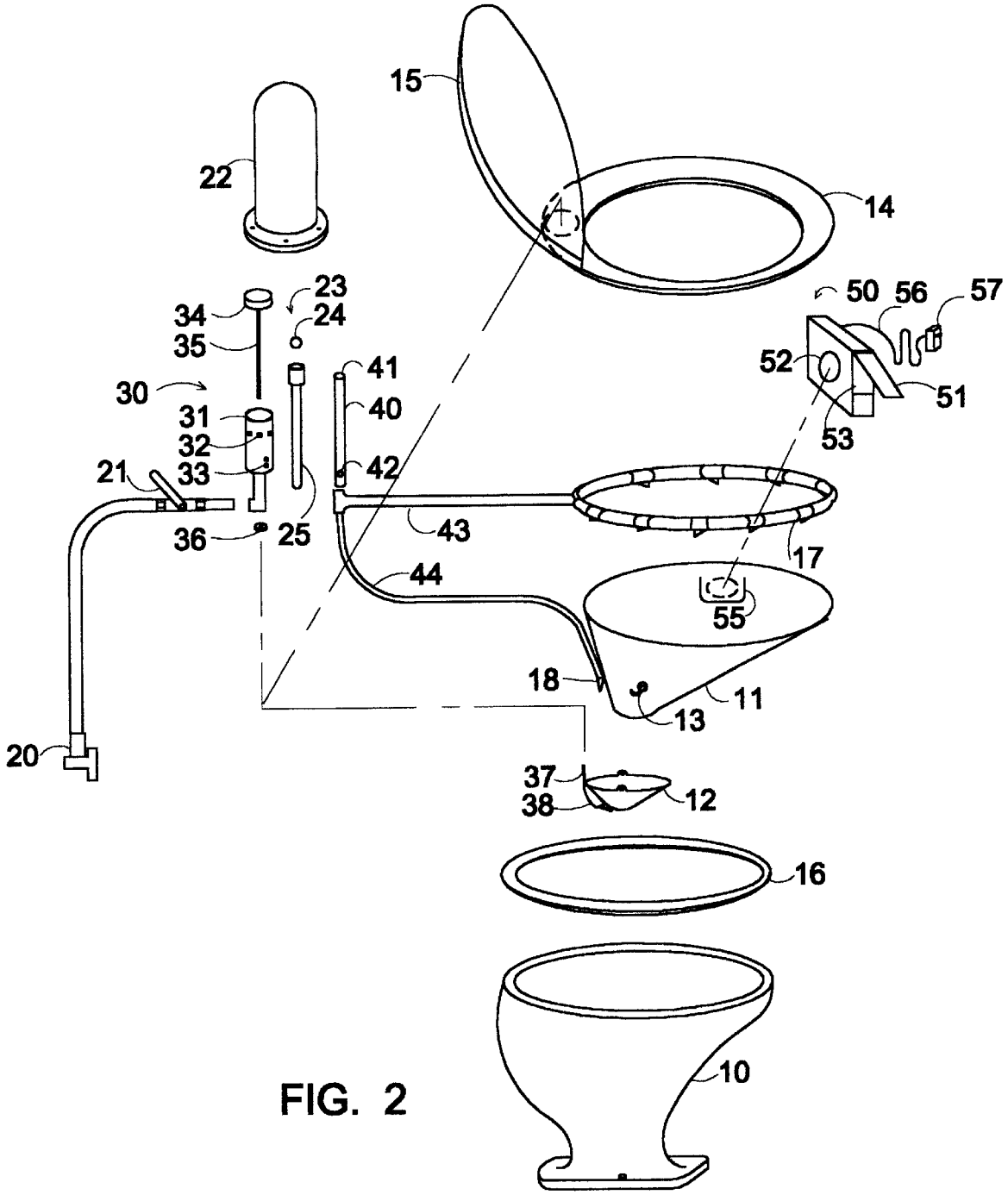
FIG. 2 is an exploded view of a toilet including a flushing and cleaning device according to an embodiment of the present invention.
Figure 3B:
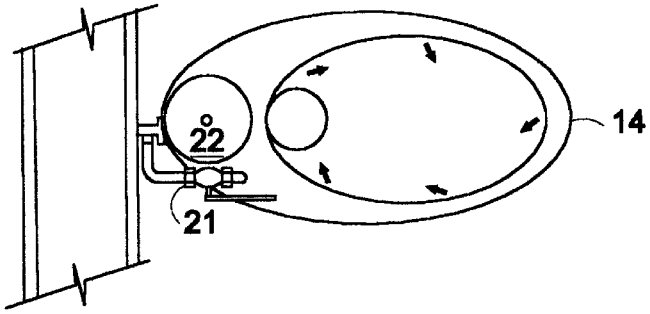
FIG. 3B is a top view of a toilet including a flushing and cleaning device according to an embodiment of the present invention.
Figure 3A:
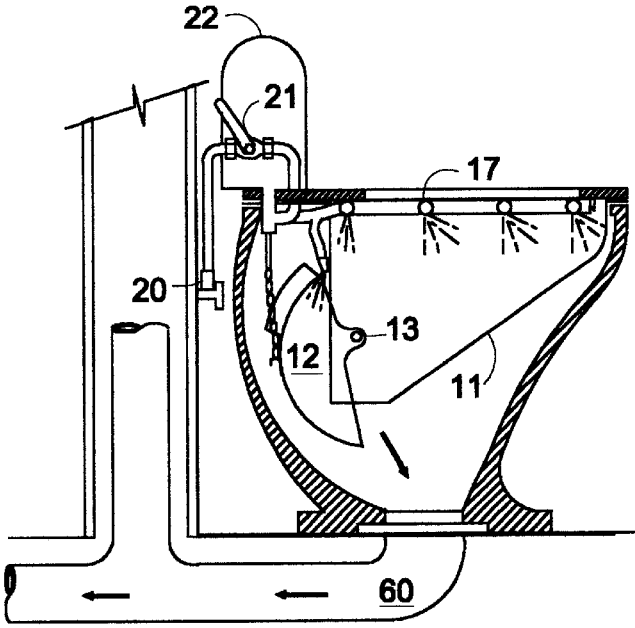
FIG. 3A is a cutaway side view of a toilet including a flushing and cleaning device according to an embodiment of the present invention.
Figure 3C:
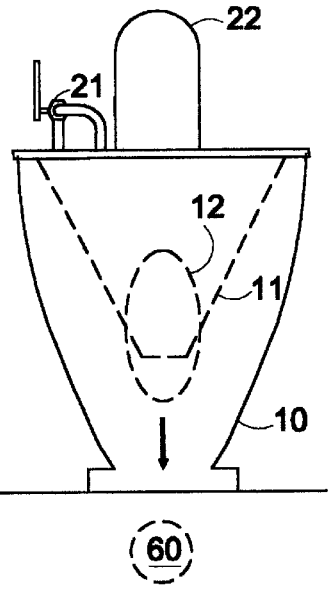
FIG. 3C is a front view of a toilet including a flushing and cleaning device according to an embodiment of the present invention.

Reference is now made to the figures wherein like parts are referred to by like numerals throughout. Referring to FIG. 1, in appearance the toilet looks very much like a conventional toilet with a bowl 10 having a seat 14 and lid 15 mounted thereon. The toilet is connected to a water source and a drain pipe 60 below the level of the floor 63. A vent pipe 61 behind a wall 62 connects to the drain pipe 60 to vent gas from the waste.

Referring to FIGS. 2, 3A, 3B, and 3C, the toilet includes a reservoir 22. The volume of the reservoir 22 could be any size, however, in an embodiment including a bucket 12, described in more detail below, the volume of the reservoir 22 is substantially equal to the volume of the bucket 12. This reservoir 22 is connected to a water supply controlled using a shut-off valve 20.

In the optional embodiment of the figures, the reservoir 22 includes an air inlet 25 regulated by a check valve assembly 23. The check valve assembly 23 of FIG. 2 includes a check ball valve 24 disposed over an air inlet tube 25 such that air is prevented from escaping through the air inlet 25 when the air pressure inside the reservoir 22 is greater than ambient but permits air to enter the reservoir 22 when the air pressure differential is sufficient to displace the check ball valve 24.

The reservoir 22 includes a cylinder 31 with a base and a top. At least one drain hole 33 is located near the base of the cylinder 31 and at least one discharge hole 32 is located near the top of the cylinder 31. A piston 34 is slidably disposed inside the cylinder 31 such that the piston 34 can move between the base and top of the cylinder 31.

A mixer tube 40 is also disposed inside the reservoir 22. The mixer tube 40 includes an air entrance 41 at its upper end and a water entrance 42 at its lower end. The mixer tube 40 is connected via hoses 43, 44 to a plurality of spray nozzles 17, 18. In the optional embodiment of FIG. 2 including a funnel 11 and a bucket 12, a set of spray nozzles 17 are directed at the funnel 11 and at least one spray nozzle 18 is directed into the bucket 12.

As discussed above, a funnel 11 may be disposed inside the toilet bowl 10. The funnel 11 includes an upper opening and a lower opening. In such an embodiment, the funnel 11 is attached to the lower side of the toilet seat 14 approximately along the center of its inside and outside perimeters. Then, the outside flange of the toilet seat 14 is used to support and seal the funnel 11 against the bowl 10 rim. A gasket 16 may be provided to form the seal. In such an embodiment, the inside of the toilet seat 14 may support the spray nozzles 17 directed at the funnel 11.

The funnel 11 optionally has two hooks 13 near its bottom that suspend a bucket 12. The bucket 12 includes substantially continuous walls and an opening. The shape of the bucket 12 closely follows the shape of the bottom of the funnel 11 to reduce the amount of water required. When filled with water, the bucket 12 is seated in, and seals with, the funnel 11 to prevent noxious odors from escaping from the sewer. In its normal position, the bucket 12 is oriented with its opening vertically upward. The bucket 12 is pivotable between its position with the opening directed vertically upward and a position rotated approximately ninety degrees such that the opening permits the contents of the bucket 12 to drain. The swinging can be accomplished in different ways, in the embodiment shown, the cylinder 31 is utilized. In such an embodiment, one side of the bucket 12 is connected to a rod 35 extending from the piston 34. Optionally, the attachment is a chain 37 threaded through a seal 36 at the base of the cylinder 31. When the piston 34 is at the base of the cylinder 31, the bucket 12 is at its normal position with the opening vertically upward. As the piston 34 is driven to the top of the cylinder 31, the bucket 12 is pivoted. A counterweight 38 may be provided to bias the bucket 12 in its normal position.

Figure 4C:
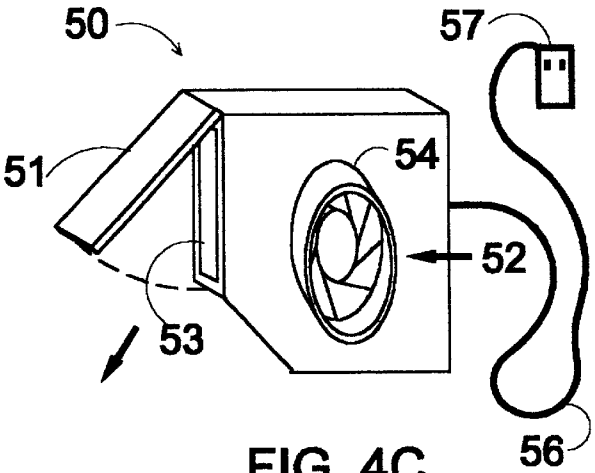
FIG. 4C is an elevated view of a ventilation device according to an embodiment of the present invention.
Figure 4B:
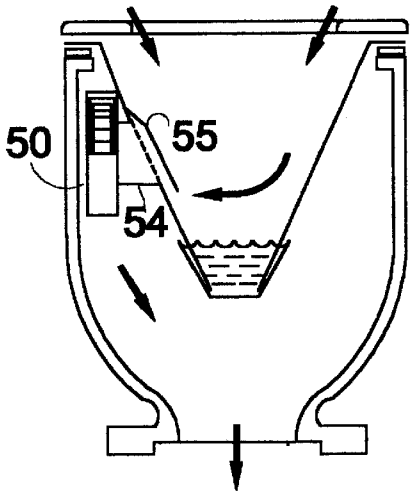
FIG. 4B is a cutaway front view of a toilet having a flushing and cleaning device according to an embodiment of the present invention that includes a blower.
Figure 4A:
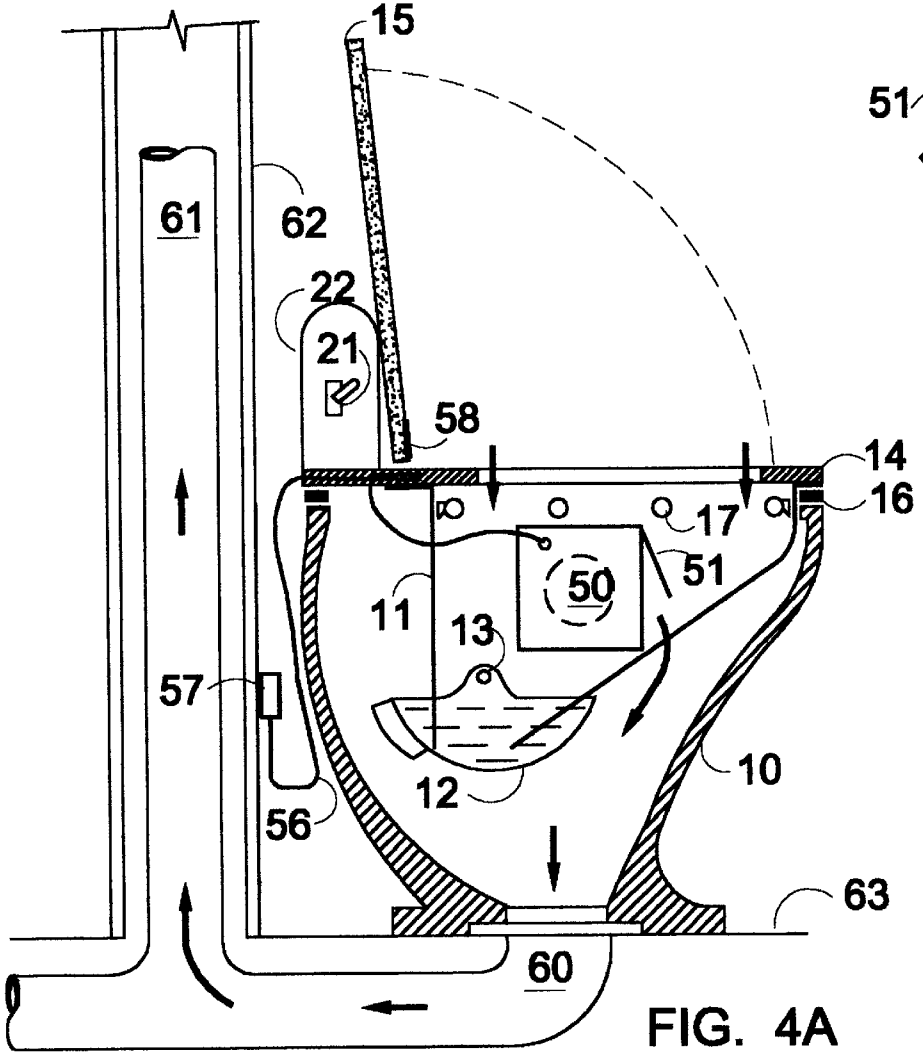
FIG. 4A is a cutaway side view of a toilet having a flushing and cleaning device according to an embodiment of the present invention that includes a blower.

In a further optional embodiment, shown in FIGS. 4A, 4B, and 4C, a small, low voltage blower 50 is disposed between the funnel 11 and the bowl 10. The blower 50 optionally includes a direct current power supply 57 connected to the blower 50 through a cord. The blower 50 is oriented to draw air and any odors from inside the funnel 11 through a blower inlet 52 connected to an inlet duct 54. The inlet duct 54 is aligned with a hole in the funnel 11 protected with a splash shield 55. The air is delivered via a blower outlet 53 to the lower side of the funnel 11 through an air check register 51. Once on the other side of the funnel 11 the odors are free to go through the drain piping 60 into the vent piping 61.

The use of the ventilation system is shown in FIGS. 4A, 4B and 4C. When the seat cover 15 is lifted a switch 58 turns on the power for the blower 50. The forced air from the blower 50 opens an air check register 51, which may be assisted by a solenoid (not shown), and the odors are carried through the existing drain piping 60 and the vent piping 61 to the outside of the building. This venting process remains in effect until the end of the operation when the seat cover 15 is lowered down.

Figure 5A:
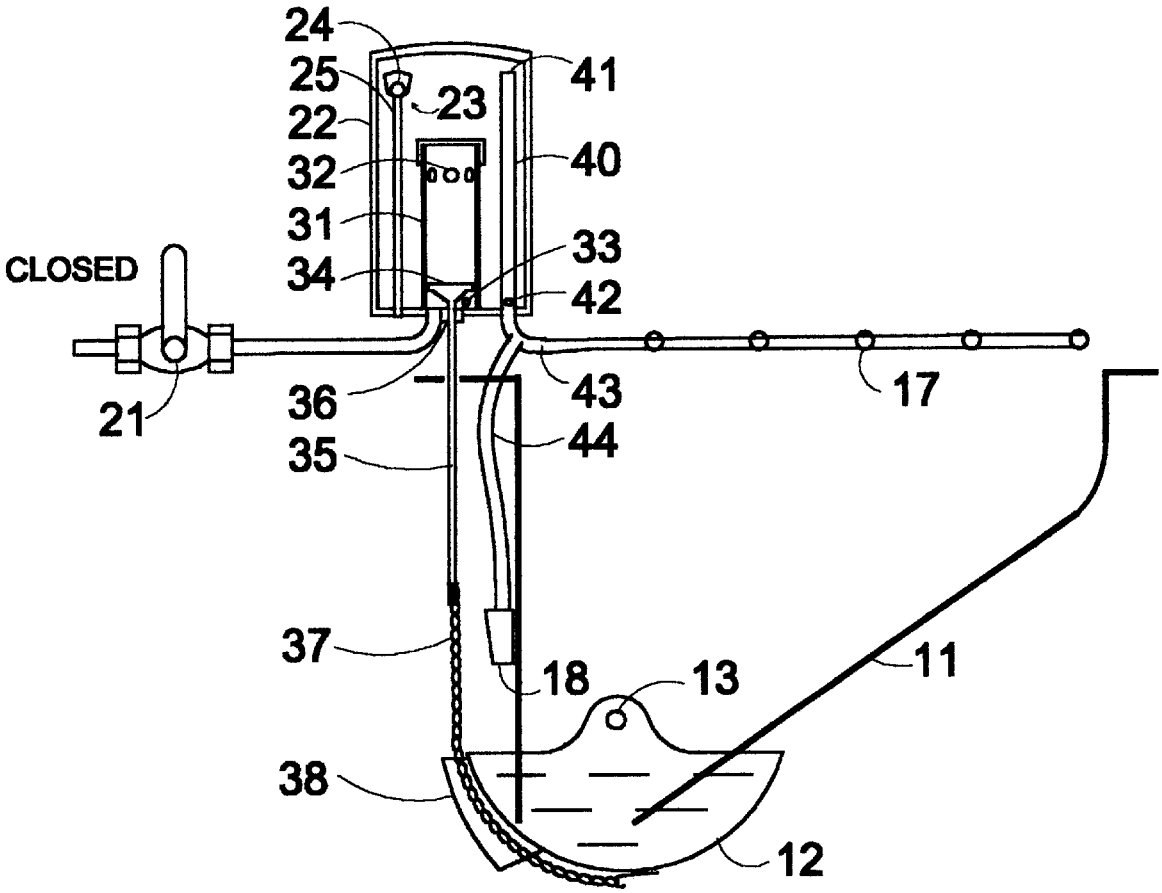
FIG. 5A is a cutaway side view of a toilet having a flushing and cleaning device according to an embodiment of the present invention prior to activation.

The use of the flushing system is illustrated in FIGS. 5A, 5B, 5C and 5D. FIG. 5A shows the initial state of the toilet. The water flushing valve 21 is closed, the reservoir 22 is empty, and the bucket 12 is full of water and oriented with the opening upwards.

Figure 5B:
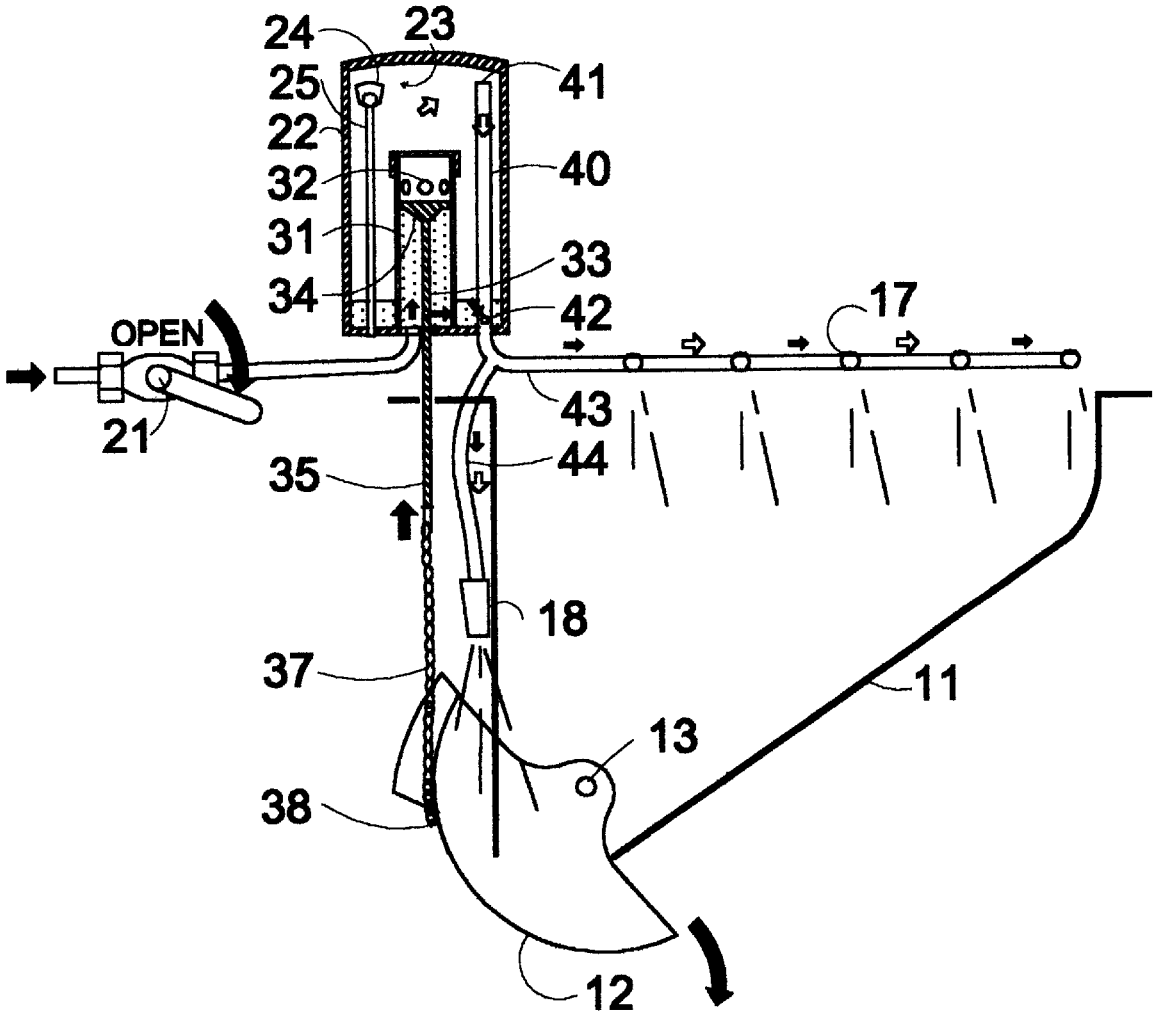
FIG. 5B is a cutaway side view of a toilet having a flushing and cleaning device according to an embodiment of the present invention immediately after activation.

FIG. 5B shows when the cleaning begins. The water flushing valve 21 is opened and water rushes through a hose to the cylinder 31. The piston 34 is driven upwards. The upward motion of the piston 34 forces air through the discharge holes 32. The drain hole 33 at the bottom of the cylinder 31 allows water to escape the cylinder 31 in a controlled fashion and flow to the water entrance 42 of the mixing tube 40. In this fashion, the drain hole 33 also regulates the water pressure on the piston 34 by diverting any excess force. Even before the piston 34 reaches the discharge holes 32 the water from the drain hole 33 starts to flow to the rim sprays 17 and bucket sprays 18 through the hoses 43, 44 and the water entrance 42 of the mixer tube 40. During this time, the check valve 24 of the reservoir 22 is closed by gravity and the increasing air pressure. The check valve 24 prevents air from escaping outside the reservoir 22, and the increasing pressure of the vessel from the incoming water helps the check valve 24 to remain closed.

In an embodiment including a bucket 12, the motion of the piston simultaneously 34 lifts one side of the bucket 12 and its counterweights 38 causing the bucket 12 to pour its contents. As long as the flushing valve 21 remains open there will be enough pressure of the water acting on the piston 34 to keep the bucket 12 tilted.

Figure 5C:
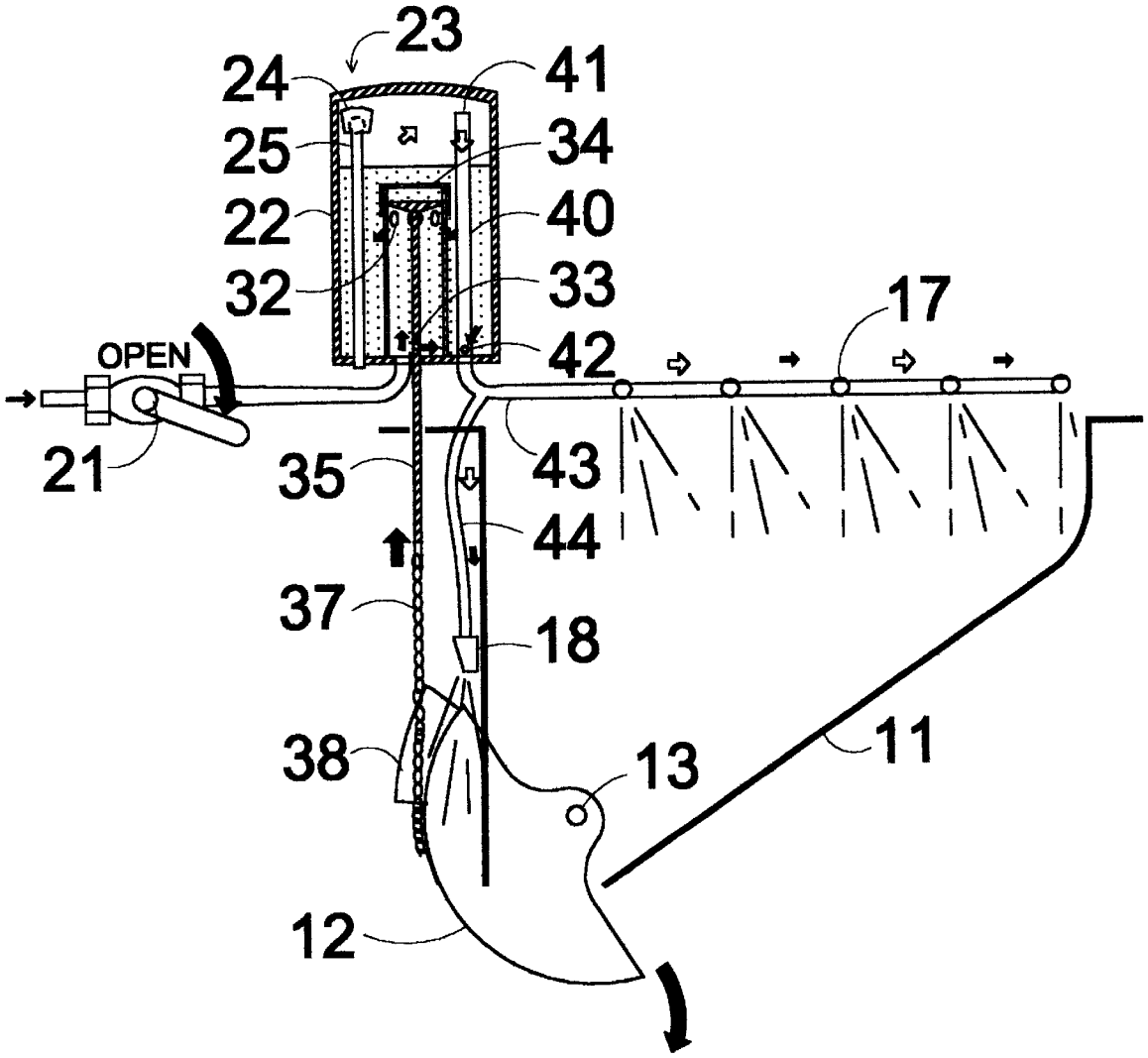
FIG. 5C is a cutaway side view of a toilet having a flushing and cleaning device according to an embodiment of the present invention after the device has been activated.

FIG. 5C shows when the piston 34 has reached its maximum height and the cylinder discharge holes 32 are overflowing. The water entrance hole 42 of the mixer tube 40 is not large enough for this flow and the level of water in the reservoir 22 rises quickly. This causes pressurization of the air in the reservoir 22 and forces air into the air entrance hole 41 where it mixes with the water from the water entrance hole 42 creating pulsating burst of air and water that is exceptionally adapted for cleaning purposes.

Figure 5D:
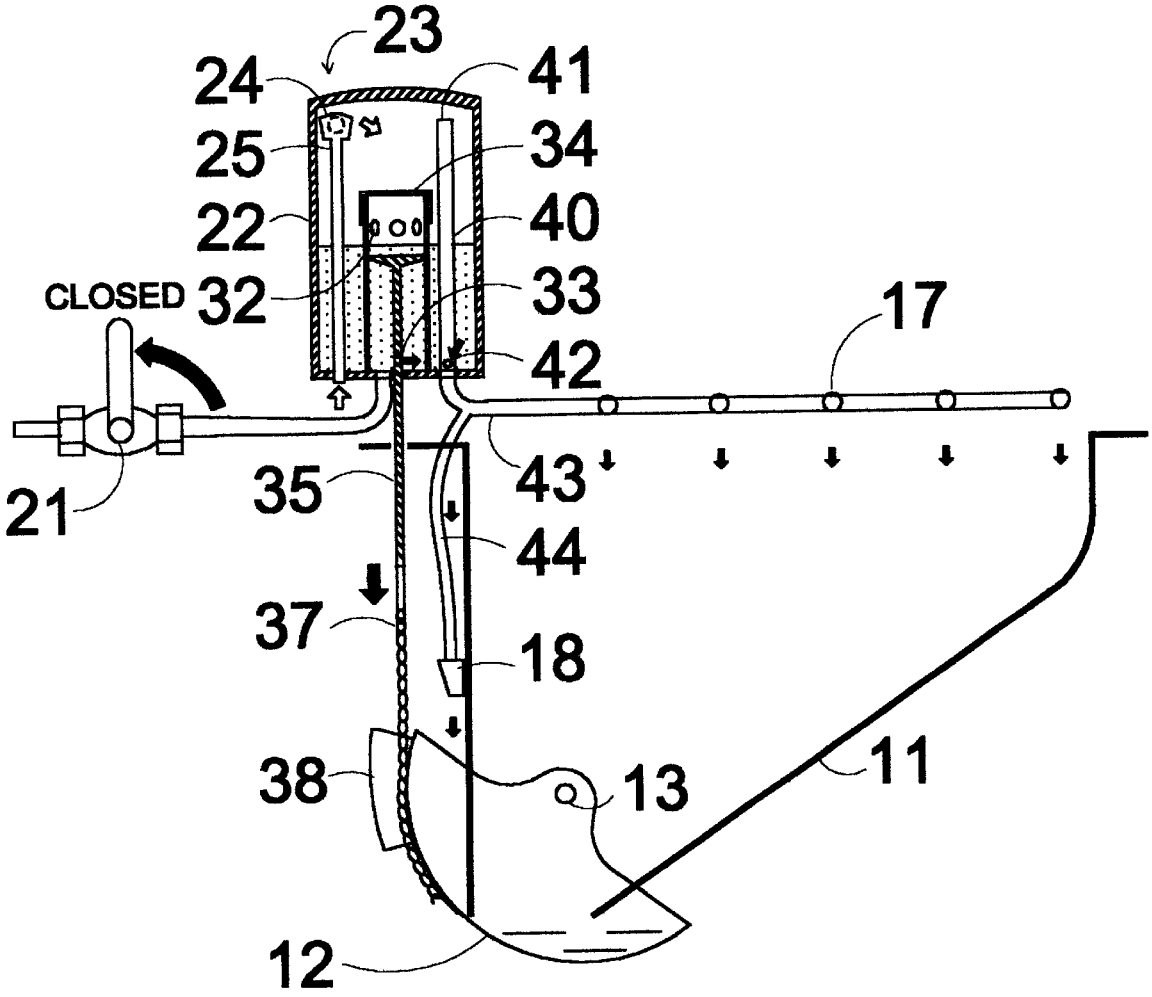
FIG. 5D is a cutaway side view of a toilet having a flushing and cleaning device according to an embodiment of the present invention upon deactivation.

Finally in FIG. 5D, the flush water valve 21 is closed by manual or automatic means and the water flowing into the cylinder 31 is stopped. The piston 34 is released and it moves from the top of the cylinder 31 to the base of the cylinder 31. In an embodiment including a bucket, the piston 34 is forced to the base of the cylinder 31 by the weight of the counterweights 38. The motion of the piston 34 forces any remaining water out of the cylinder 31 and causes a drop in air pressure in the reservoir 22. In the embodiment of FIG. 5D, the water forced out of the cylinder 31 falls by gravity through the spray nozzles 17, 18. The drop in pressure permits the check valve 24 to open and air enters through the air inlet 25. As the piston 34 moves from the top of the cylinder 31 to the base of the cylinder 31, the bucket 12 returns to its normal position. The water remaining in the reservoir 22 goes to the sprays 17, 18 and fills the bucket 12 to provide a water seal and prepare for the next cycle.

While certain embodiments of the present invention have been shown and described it is to be understood that the present invention is subject to many modifications and changes without departing from the spirit and scope of the claims presented herein.

I claim:

1. A toilet flushing and cleaning device for a toilet connected to a water source delivering water under pressure, the toilet including a bowl, comprising:

a reservoir;

a cylinder having a base and a top disposed in said reservoir, said cylinder including at least one discharge hole at its top, said cylinder in fluid communication with said water source;

a piston disposed in said cylinder slidable between said base and said top;

a mixer tube having a lower end and an upper end disposed in said reservoir, said mixer tube including a water entrance hole at its lower end and an air entrance hole at its upper end;

spray nozzles fluidly communicating with said mixer tube directed into said toilet bowl; and a flush valve disposed between said water source and said cylinder such that when said flush valve is opened, water from said water source drives said piston from the base to the top of said cylinder forcing air through the discharge hole in said cylinder to increase the air pressure inside said reservoir and force air into the air entrance hole in said mixer tube, the air mixing with water entering through the water entrance hole in said mixer tube, the air-water mixture flowing to said spray nozzles.

2. The device of claim 1 further comprising a funnel having an upper opening substantially sealed to said toilet bowl and a lower opening, said spray nozzles disposed around the upper opening of said funnel and directed into said funnel.

3. The device of claim 2 further comprising a blower disposed between said funnel and said toilet bowl drawing air from inside said funnel and directing air into said toilet bowl.

4. The device of claim 2 further comprising:

a bucket pivotally mounted inside said funnel over the lower opening with at least one of said spray nozzles directed into said bucket, said bucket having a substantially continuous surface with an opening, said bucket connected at one point on its surface to said piston such that the bucket opening is oriented vertically upward when said piston is at the base of said cylinder, said bucket opening pivoting approximately ninety degrees when said piston is driven to the top of said cylinder; and a counterweight disposed on said bucket at the same end as the connection to said piston to rotate said bucket opening is oriented vertically upward when said piston is at the base of said cylinder.

5. A toilet flushing and cleaning device for a toilet connected to a water source delivering water under pressure, the toilet including a bowl, comprising:

a funnel having an upper opening substantially sealed to said toilet bowl and a lower opening;

a reservoir including an air inlet regulated by a check valve, said check valve preventing air from escaping through said air inlet when the air pressure inside said reservoir is greater than ambient pressure and allowing air to enter through said air inlet when the air pressure inside said reservoir is less than or equal to ambient pressure;

a cylinder having a base and a top disposed in said reservoir, said cylinder including at least one drain hole at its base and at least one discharge hole at its top, said cylinder in fluid communication with said water source;

a piston disposed in said cylinder slidable between said base and said top;

a mixer tube having a lower end and an upper end disposed in said reservoir, said mixer tube including a water entrance hole at its lower end and an air entrance hole at its upper end;

spray nozzles fluidly communicating with said mixer tube disposed around the upper opening of said funnel and directed into said funnel; and a flush valve disposed between said water source and said cylinder such that when said flush valve is opened, water from said water source drives said piston from the base to the top of said cylinder forcing air through the discharge hole in said cylinder to increase the air pressure inside said reservoir and force air into the air entrance hole in said mixer tube, the air mixing with water entering through the water entrance hole in said mixer tube from the drain hole in said cylinder, the air-water mixture flowing to said spray nozzles, and when said flush valve is closed, said piston slides from the top to the base of said cylinder reducing the air pressure in said reservoir to open said check valve and permit air to enter the reservoir through said air inlet.

6. The device of claim 5 further comprising a blower disposed between said funnel and said toilet bowl drawing air from inside said funnel and directing air into said toilet bowl.

7. The device of claim 5 further comprising:

a bucket pivotally mounted inside said funnel over the lower opening with at least one of said spray nozzles directed into said bucket, said bucket having a substantially continuous surface with an opening, said bucket connected at one point on its surface to said piston such that the bucket opening is oriented vertically upward when said piston is at the base of said cylinder, said bucket opening pivoting approximately ninety degrees when said piston is driven to the top of said cylinder; and a counterweight disposed on said bucket at the same end as the connection to said piston to rotate said bucket opening is oriented vertically upward when said piston is at the base of said cylinder.

8. A toilet flushing and cleaning device for a toilet connected to a water source delivering water under pressure, the toilet including a bowl, comprising:

a funnel having an upper opening substantially sealed to said toilet bowl and a lower opening;

a blower disposed between said funnel and said toilet bowl drawing air from inside said funnel and directing air into said toilet bowl;

a reservoir including an air inlet regulated by a check valve, said check valve preventing air from escaping through said air inlet when the air pressure inside said reservoir is greater than ambient pressure and allowing air to enter through said air inlet when the air pressure inside said reservoir is less than or equal to ambient pressure;

a cylinder having a base and a top disposed in said reservoir, said cylinder including at least one drain hole at its base and at least one discharge hole at its top, said cylinder in fluid communication with said water source;

a piston disposed in said cylinder slidable between said base and said top;

a mixer tube having a lower end and an upper end disposed in said reservoir, said mixer tube including a water entrance hole at its lower end and an air entrance hole at its upper end;

spray nozzles fluidly communicating with said mixer tube disposed around said funnel, said spray nozzles directed into said funnel;

a bucket pivotally mounted inside said funnel over the lower opening with at least one of said spray nozzles directed into said bucket, said bucket having a substantially continuous surface with an opening, said bucket connected at one point on its surface to said piston such that the bucket opening is oriented vertically upward when said piston is at the base of said cylinder, said bucket opening pivoting approximately ninety degrees when said piston is driven to the top of said cylinder;

a counterweight disposed on said bucket at the same end as the connection to said piston to rotate said bucket opening is oriented vertically upward when said piston is at the base of said cylinder; and a flush valve disposed between said water source and said cylinder such that when said flush valve is opened, water from said water source drives said piston from the base to the top of said cylinder simultaneously pivoting said bucket and forcing air through the discharge hole in said cylinder to increase the air pressure inside said reservoir and force air into the air entrance hole in said mixer tube, the air mixing with water entering through the water entrance hole in said mixer tube from the drain hole in said cylinder, the air-water mixture flowing to said spray nozzles, and when said flush valve is closed, said piston slides from the top to the base of said cylinder simultaneously releasing said bucket to pivot and reducing the air pressure in said reservoir to open said check valve and permit air to enter the reservoir through said air inlet.

* * * * *